US007784784B2

(12) United States Patent
Meyerhans et al.

(10) Patent No.: US 7,784,784 B2
(45) Date of Patent: Aug. 31, 2010

(54) METHOD AND APPARATUS FOR TRANSFERRING PRINTED PRODUCTS CONVEYED IN AN SHINGLED FLOW TO A TRANSPORTER WITH CIRCULATING CLAMPS

(75) Inventors: Rolf Meyerhans, Reiden (CH); Ueli Mattmann, Lostorf So (CH)

(73) Assignee: Mueller Martini Holding AG, Hergiswil (CH)

( * ) Notice: Subject to any disclaimer, the term of this patent is extended or adjusted under 35 U.S.C. 154(b) by 151 days.

(21) Appl. No.: 12/175,136

(22) Filed: Jul. 17, 2008

(65) Prior Publication Data

US 2009/0022573 A1 Jan. 22, 2009

(30) Foreign Application Priority Data

Jul. 17, 2007 (EP) ..... 07405209

(51) Int. Cl.
*B65H 29/04* (2006.01)

(52) U.S. Cl. ..... 271/204; 271/69; 271/185; 414/226.01

(58) Field of Classification Search ..... 271/185, 271/204; 414/226.01, 806
See application file for complete search history.

(56) References Cited

U.S. PATENT DOCUMENTS 4,039,182 A 8/1977 Reist et al.
4,201,286 A * 5/1980 Meier ..... 271/206
5,042,792 A * 8/1991 Honegger et al. ..... 271/188
2007/0216086 A1* 9/2007 Kyburz ..... 271/204

FOREIGN PATENT DOCUMENTS

| | | | |
|---|---|---|---|
| EP | 0 380 921 | A2 | 1/1990 |
| EP | 0 368 009 | A | 5/1990 |
| EP | 0 481 914 | A1 | 4/1992 |
| EP | 0 551 601 | A | 7/1993 |
| EP | 0 965 547 | A | 12/1999 |
| EP | 1 398 286 | A | 3/2004 |
| WO | WO-01/64565 | A | 9/2001 |

OTHER PUBLICATIONS

European Search Report dated Jan. 9, 2008 issued in Priority Application No. EP 07405209.3.

* cited by examiner

*Primary Examiner*—Saúl J Rodríguez
*Assistant Examiner*—Gerald W McClain
(74) *Attorney, Agent, or Firm*—Venable LLP; Robert Kinberg; Justine A. Gozzi

(57) ABSTRACT

An apparatus and method for transferring printed products conveyed in a shingled flow in a conveying direction by a conveyor to a transporter positioned above the conveyor. The shingled flow is conveyed with circulating clamps. Each printed product respectively projects with a leading end over a front end of a following printed product in the conveying direction and the circulating clamps respectively clamp the leading end of the printed products. Each printed product is lifted from below along one side of the shingled flow in a transfer region formed by the shingled flow and the above-positioned transporter. After the printed products are is lifted up, a trailing end of each printed product is gripped by a clamp of the transporter and then the printed products are further transported.

13 Claims, 3 Drawing Sheets

METHOD AND APPARATUS FOR TRANSFERRING PRINTED PRODUCTS CONVEYED IN AN SHINGLED FLOW TO A TRANSPORTER WITH CIRCULATING CLAMPS

CROSS-REFERENCE TO RELATED APPLICATION

This application claims the priority of the European Patent Application No. 07405209.3-1256, filed on Jul. 17, 2007, the subject matter of which is incorporated herein by reference.

BACKGROUND OF THE INVENTION

The invention relates to a method and apparatus for transferring printed products that are conveyed in a shingled flow to a transporter with circulating clamps.

According to a method disclosed in the European patent document 0 481 914 A1, printed products conveyed in a shingled flow are gripped by the clamps of a transporter and are conveyed further while suspended from these clamps. Along one segment of a conveying section, guide elements are inserted into the conveyed flow of suspended products and move along in the conveying direction, wherein these elements guide the printed products over at least a portion of this segment, thereby providing a defined, stable position for these products in at least one location, independent of the conveying speed.

European patent document 0 380 921 A2 discloses a device for transferring printed products, suspended from the clamps of a transporter, in a transfer region to the holding compartments of a fan wheel that is rotating in the same direction and with the same timing in the transfer region. The fan wheel turns over the printed products, which are then supplied fold-forward to a further processing device.

SUMMARY

It is an object of the present invention to create a method and apparatus, based on a simple and reliable principle, for transferring the supplied printed products to a transporter.

The above and other objects are accomplished according to one aspect of the invention wherein there is provided, in one embodiment, an apparatus and method for transferring printed products conveyed in a shingled flow in a conveying direction by a conveyor to a transporter positioned above the conveyor, comprising: conveying the shingled flow with circulating clamps of the conveyor such that each printed product respectively projects with a leading end over a front end of a following printed product in the conveying direction and the circulating clamps respectively clamp the leading end of the printed products; lifting up each printed product from below along one side of the shingled flow in a transfer region formed by the shingled flow and the above-positioned transporter which moves at approximately the same speed and in the same direction as the conveyor and; after the lifting step, gripping a trailing end of each printed product by a clamp of the transporter and then further transporting the printed products.

Thus, according to the invention, the printed products, which respectively project with a leading end past the front end of a following printed product as seen in conveying direction, are lifted up from below along one side edge region of the conveyed flow in a transfer region formed by the conveyed flow and the above-arranged transporter moving in the same direction. The trailing end of a printed product is gripped by an opened clamp of the transporter that is driven at a higher transporting speed, is then clamped in, and conveyed further. As a result, the printed products can be positioned precisely, relative to the open clamps of the transporter which hold and/or take over the printed products, despite the effects of the air resistance and other influences. The proposed method has furthermore proven to be a gentle method.

A force counter to the direction for lifting the printed products, which guides these products on the surface, is advantageously provided in the transfer region, meaning in the region where the printed products are transferred from the conveyed flow to the transporter.

A device according to an embodiment of the invention for transferring printed products conveyed in a shingled flow to a transporter with circulating clamps is distinguished in that a lifting mechanism is provided for the printed products, which respectively project with a leading end over the front end of a trailing printed product and are conveyed by the grippers of a conveyor. The lifting mechanism, which acts from both sides along the side edges from below upon the conveyed flow, is provided in a transfer region that is formed by the shingled flow and the above-arranged transporter, circulating with a higher speed.

BRIEF DESCRIPTION OF THE DRAWINGS

The present invention will be more readily understood from the following detailed description when read in conjunction with the accompanying drawings, in which.

DETAILED DESCRIPTION

Figure 1:
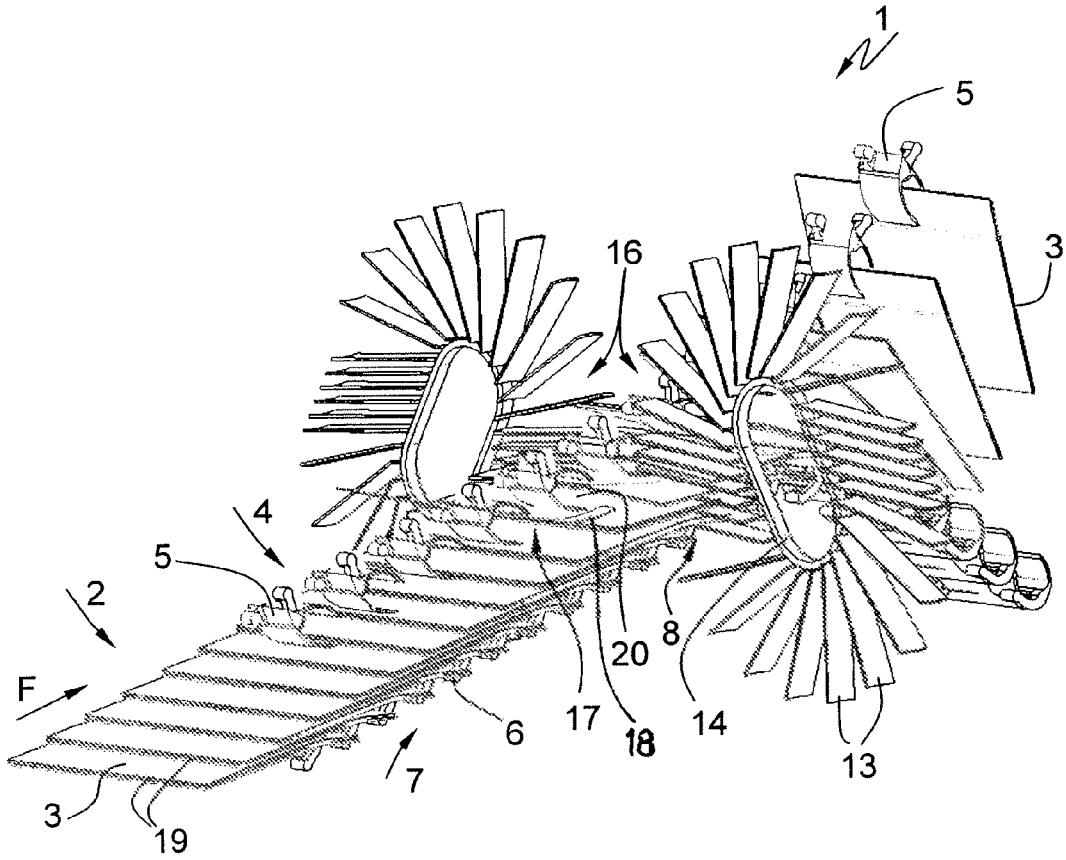
FIG. 1 is a three-dimensional representation of the device according to the invention.

FIG. 1 shows a device 1 for transferring printed products 3, conveyed in a shingled flow 2, to a transporter 4 with circulating clamps 5. The conveyed flow 2 is arranged in a shingled formation in which respectively the leading end of a printed product 3 projects past the front end of a following printed product 3. The printed products 3 are gripped at the leading, open or folded edge by the grippers 6 of a conveyor 7 and are clamped in. The grippers 6 are attached to a circulating traction device 9, e.g. as indicated by the dash-dot line (See FIG. 2). The grippers 6 move past a stationary control element (not shown herein) in a transition region 8. The stationary control element opens the grippers 6 and removes the printed products 3 from the latter.

Figure 2:
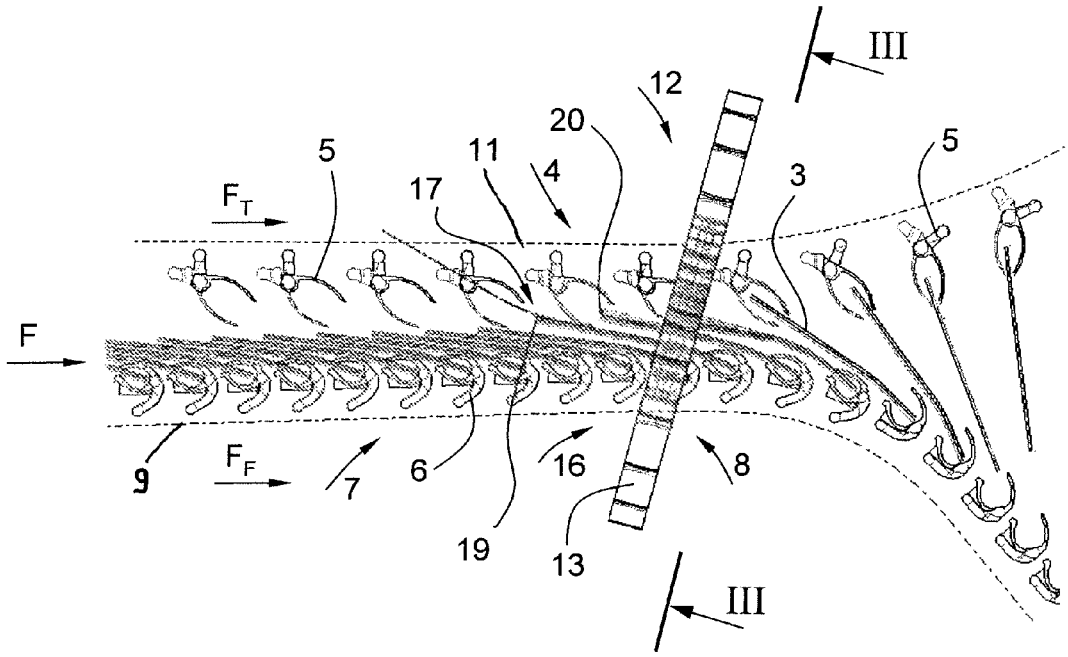
FIG. 2 is a side view of the device shown in FIG. 1.

A transporter 4, circulating continuously with approximately the same speed and in the same direction, is arranged above the conveyed flow 2. The transporter 4 is provided with clamps 5 which are uniformly spaced apart and attached to a traction device 11, as indicated by a dot-dash line as shown in FIG. 2. The conveyor 7, driven underneath the transporter 4 or its working belt section, pulls the shingled printed products 3 into the transfer region 8. Consequently, a lifting mechanism 12 can be inserted underneath the front side area of the printed products and/or the printed products can be gripped and can be guided at least approximately over the length of the conveying direction F. The lifting mechanism 12 comprises a plurality of vanes 13, which are inserted in the transition region 8 along both side edge regions 10 (See FIG. 3) into the conveyed flow 2 of the printed products 3. The vanes are approximately perpendicular to or in a slightly inclined position relative to the conveying direction F. The vanes are driven circulating and once they reach the front end on the side of a printed product 3, the product respectively glides over a vane 13 while it is lifted up.

Figure 3:
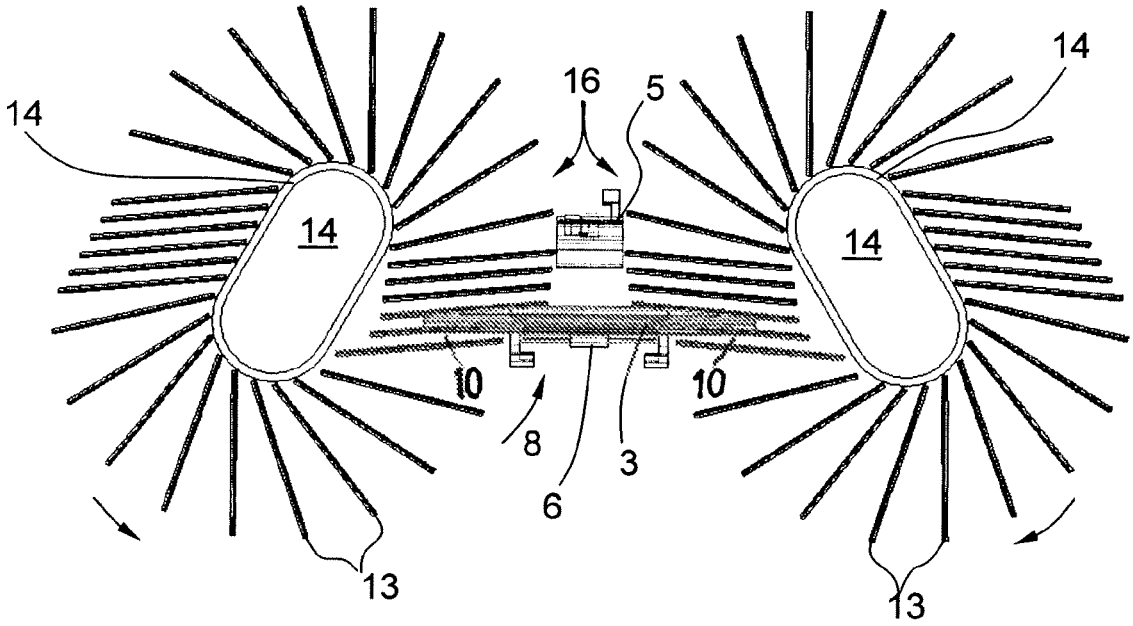
FIG. 3 is a cross section through the device along the line III-III in FIG. 2.

The vanes 13 are connected on one side, for example with one longitudinal side end, to a circulating vane holder 14. The vane holder 14 can be embodied as a wheel or, as shown in FIGS. 1 to 3, as a belt, a chain or the like. The vanes 13 can be embodied plate-shaped or board-shaped. The vanes 13 can be connected via a joint to the vane holder 14 so that the vanes 13 can be controlled. A stationary control cam is preferably used for the control of the vanes 13. The stationary control cam can be operatively connected to the vanes 13 (see FIG. 3) with the aid of a lever gear (not shown herein). The lifting mechanism 12 is arranged relative to the conveyed flow 2 so that a circulation path 15 for the vanes 13 comprises a section and/or a lifting section 16 that is slanted in an upward direction, relative to the conveyed flow 2.

The figures show that the position of the vanes 13 can be controlled, especially in the transfer region 8, so that the printed products 3 are treated carefully. The vanes 13 can extend nearly to the clamps 5 of the transporter 4 and/or to the grippers 6 of the conveyor 7. The extension of the vanes 13 allows the printed products 3 to glide easily across the vanes while they are lifted up. In order to optimize conditions and based on the paths of the transporter 4 and the conveyor 7, the lifting mechanism 12 can, as shown with FIG. 2, occupy a slightly inclined position in the transition region. The angle of the lifting mechanism 12 can be adjusted relative to the conveyed flow 2, the format of the printed products 3 that are passing through, or to other conditions.

To stabilize the conveyed flow 2 and determine the position of a printed product 3 in the transition region 8, a guiding device 17 is provided. The guiding device 17 cooperates with the opened clamps 5 of the transporter 4, so as to align the printed products 3 with the opened clamps 5. This guiding device 17 holds the printed products 3. The printed products 3 extend from the grippers 6 in a direction counter to the conveying direction F. The printed products 3 can be picked up at the rear by the opened clamps 5 of the transporter 4. The opened clamps 5 are guided out at a higher speed than the grippers 6 of the conveyor 7.

As shown, the guiding device 17 can include a rigid or an elastic bar 18. The bar 18 guides the printed products 3 to the rear edge 19. The bar 18 is then removed so that the rear edge 19 can move into the area where the clamps are opened and where the printed product 3 can subsequently be gripped by a clamp 5. The lifting mechanism 12 becomes effective after a printed product 3 has left the guiding device 17. As a result, the conveyor 7, the transporter 4, the guiding device 17, and the lifting mechanism 12 operate with synchronized timing.

The functional tasks of the aforementioned components can respectively be adjusted and/or readjusted in order to adapt to the synchronized operation of these components. Thus, the speeds of the transporter 4 and the conveyor 7, the position of the guiding device 17 and the lifting mechanism 12 can be changed, either manually or using a motor. Finally, it should also be mentioned that the guiding device 17 is installed upstream of the lifting mechanism 12, as seen in conveying direction F. Once the transporter 4 and the conveyor 7 leave the transfer region 8, they take diverging paths. The printed products 3 are released from the grippers 6 of the conveyor 7 in this conveying section. The clamp 5 assigned to a printed product 3 closes before the gripper 6 for the printed product 3 opens up and/or the gripper 6 opens up before the clamp 5 closes.

It will be understood that the above description of the present invention is susceptible to various modifications, changes and adaptations, and that the same are intended to be comprehended within the meaning and range of equivalents of the appended claims.

What is claimed is:

1. A method for transferring printed products conveyed in a shingled flow in a conveying direction by a conveyor to a transporter positioned above the conveyor, comprising:

conveying the shingled flow with circulating clamps of the conveyor such that each printed product respectively projects with a leading end over a front end of a following printed product in the conveying direction and the circulating clamps respectively clamp the leading end of the printed products;

lifting up each printed product from below along both sides of the shingled flow in a transfer region formed by the shingled flow and the above-positioned transporter which moves at approximately the same speed and in the same direction as the conveyor and;

after the lifting step, gripping a trailing end of each printed product by a clamp of the transporter and then further transporting the printed products.

2. The method according to claim 1, further including guiding the printed products that are to be lifted up in the transfer region with aid of a guide that acts upon the products from above.

3. The method according to claim 1, further including transporting the printed products while suspended.

4. A device for transferring printed products conveyed in a shingled flow in which each printed product projects with a leading end over a front end of a following printed product in a conveying direction, comprising:

a conveyor including circulating clamps that clamp from below the leading end of the respective printed products to convey the printed products in the conveying direction;

a transporter positioned above the conveyor and circulating at a higher speed than the conveyor, the shingled flow forming a transfer region with the above-positioned transporter where the printed products are transferred to the transporter, the transporter including grippers to clamp onto the printed products in the transfer region; and a lifting mechanism disposed on both sides of the shingled flow in the transfer region which acts from below the shingled flow onto side edge regions of the leading end of the printed products to lift the printed products prior to being clamped by the grippers of the transporter.

5. The device according to claim 4, wherein the lifting mechanism comprises vanes arranged to circulate approximately transverse to the conveying direction of the printed products and to lift up at least the front ends of the printed products in the transfer region.

6. The device according to claim 4, wherein the circulation of the vanes presents a circulation path that includes a section in which the vanes project from below at an angle into the shingled flow in order to lift up the printed products.

7. The device according to claim 6, wherein the vanes are controllable to be in a lifting position, in which the vanes are aligned approximately with a position of the printed products in the shingled flow.

8. The device according to claim 7, wherein the lifting mechanism includes a vane holder and the vanes are attached with one end to the circulating vane holder.

9. The device according to claim 8, wherein the vanes are hinged to the vane holder.

10. The device according to claim 4, wherein the lifting mechanism is positioned to be inclined in conveying direction.

11. The device according to claim 4, further including a guiding device in the transfer region to align the trailing ends of the printed products, which are to be lifted up in conveying direction, with the clamps of the transporter.

12. The device according to claim 11, wherein the guiding device is located upstream of the lifting mechanism, as seen in conveying direction.

13. The device according to one of the claims 4, wherein the conveyor and the transporter have paths that diverge following the lifting mechanism, as seen in conveying direction.

* * * * *